US007866839B2

(12) United States Patent
Chien

(10) Patent No.: US 7,866,839 B2
(45) Date of Patent: Jan. 11, 2011

(54) HAND TOOL WITH ILLUMINATING DEVICE

(76) Inventor: Ming-Chuan Chien, No. 41, Lane 197, Jhengguang St., Taiping City, Taichung County 411 (TW)

( * ) Notice: Subject to any disclaimer, the term of this patent is extended or adjusted under 35 U.S.C. 154(b) by 0 days.

(21) Appl. No.: 11/822,702

(22) Filed: Jul. 9, 2007

(65) Prior Publication Data

US 2010/0296271 A1 Nov. 25, 2010

(51) Int. Cl.
*B25B 23/18* (2006.01)

(52) U.S. Cl. ..... 362/119; 362/120; 362/578

(58) Field of Classification Search ..... 362/119, 362/120, 109, 102, 578, 577, 205, 206; 408/16; 81/52, 488

See application file for complete search history.

(56) References Cited

U.S. PATENT DOCUMENTS 4,107,765 A * 8/1978 Singleton et al. ..... 362/120
4,480,295 A * 10/1984 Shuster ..... 362/206
4,768,137 A * 8/1988 Hwaw et al. ..... 362/120
5,369,555 A * 11/1994 McKain et al. ..... 362/578
6,095,659 A * 8/2000 Hsu ..... 362/119
6,145,995 A * 11/2000 Hung ..... 362/119
6,199,998 B1 * 3/2001 Hsiao ..... 362/119
6,364,500 B1 * 4/2002 McCalla et al. ..... 362/120
6,905,221 B2 * 6/2005 Hsu ..... 362/119
7,278,751 B2 * 10/2007 Chang et al. ..... 362/120
2002/0145866 A1 * 10/2002 Chen ..... 362/120
2008/0278931 A1 * 11/2008 Wu et al. ..... 362/120

* cited by examiner

*Primary Examiner*—Bao Q Truong
(74) *Attorney, Agent, or Firm*—Wang Law Firm; Li K. Wang

(57) ABSTRACT

A hand tool with illuminating device includes a hollow handle with a battery unit and an illuminating unit received therein. A transparent seat is fixedly connected to a first end of the handle and includes a ratchet mechanism received therein and a tubular member is fixed to the transparent seat. A driver bit is removably inserted in the tubular member. A switch unit is connected to the second end of the handle and includes a switch member and an end cap is connected to the handle to avoid the switch member from dropping from the handle. A control device is located between the switch member and the end cap so as to control the operation of the illuminating unit.

6 Claims, 7 Drawing Sheets

HAND TOOL WITH ILLUMINATING DEVICE

FIELD OF THE INVENTION

The present invention relates to a hand tool with an illuminating device which is activated by the user to illuminate the object to be reached.

BACKGROUND OF THE INVENTION

A conventional hand tool 10 such as a screw driver is shown in FIG. 6 and generally includes a handle 11 with a driver bit 12 fixedly connected to a first end of the handle 11 and a plurality of bulbs 13 are located at the end surface of the first end of the handle 11. A switch 14 is located at a second end of the handle 11 and turns the light bulbs 13 on to illuminate the object such as a bolt head or a nut. However, the driver bit 12 is fixed to the handle 11 and no ratchet mechanism is provided to the screw driver because the light bulbs 13 occupy the position close to the driver bit 12. FIG. 7 shows another conventional hand tool 20 with an illuminating device wherein the driver 23 is removably installed to the front portion of the handle 21 and can be replaced. A light bulb cooperated with a battery 30 is received in the handle 21, a button 31 is connected to the other end of the handle 21 and positioned by an end cap 24. When operating the button 31, the light bulb lights up and the front portion of the handle 21 is made by transparent material so that the object to be reached can be seen by the light bulb. No ratchet mechanism is provided to the hand tool 20.

The present invention intends to provide a hand tool with an illuminating device and the hand tool includes a ratchet mechanism to allow the driver bit to rotate in different directions. The illuminating device is controlled by a switch and illuminates the objects to be reached via a transparent seat connected with the ratchet mechanism.

SUMMARY OF THE INVENTION

The present invention relates to a hand tool with illuminating device and comprises a hollow handle and a battery unit and an illuminating unit are received in the handle. The illuminating unit includes a circuit board which includes a bulb and two first contact points connected on two opposite sides thereof. A transparent seat is connected to a first end of the handle and includes a ratchet mechanism received therein. A tubular member is fixed to the transparent seat and engaged with the ratchet mechanism. A locking member is connected to the first end of the handle to position the transparent seat and the illuminating unit. The battery unit includes a spring connected to a first end thereof, two second contact points extend from the first end of the battery unit. A switch unit is connected to a second end of the handle and includes a switch member and an end cap which includes a through hole through which the switch member extends. The switch member is in contact with a second end of the battery unit. A control device is located between the switch member and the end cap so as to control the operation of the illuminating unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
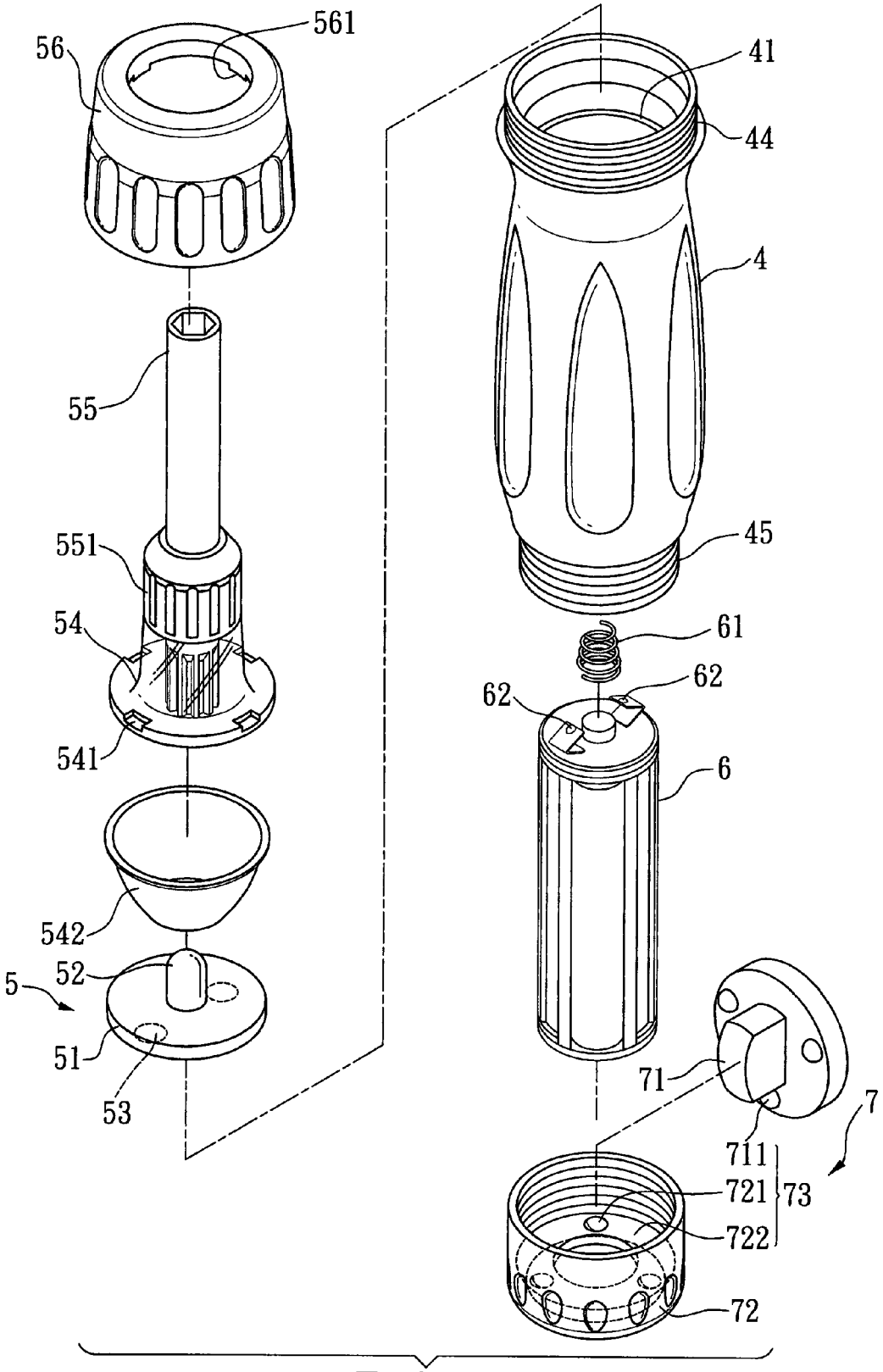
FIG. 1 is an exploded view to show the hand tool with the illuminating device of the present invention.
Figure 2:
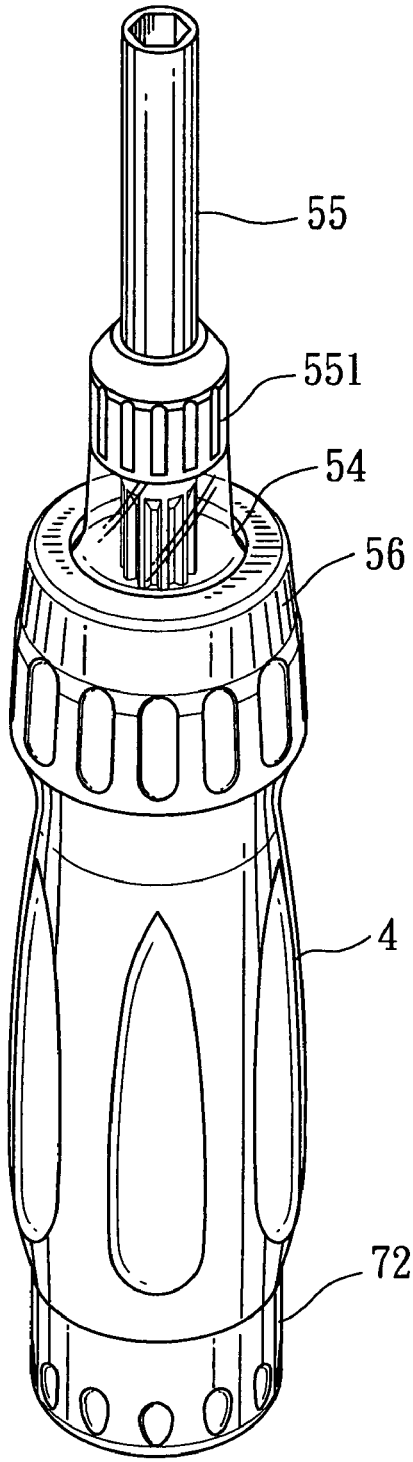
FIG. 2 is a perspective view to show the hand tool with the illuminating device of the present invention.
Figure 3:
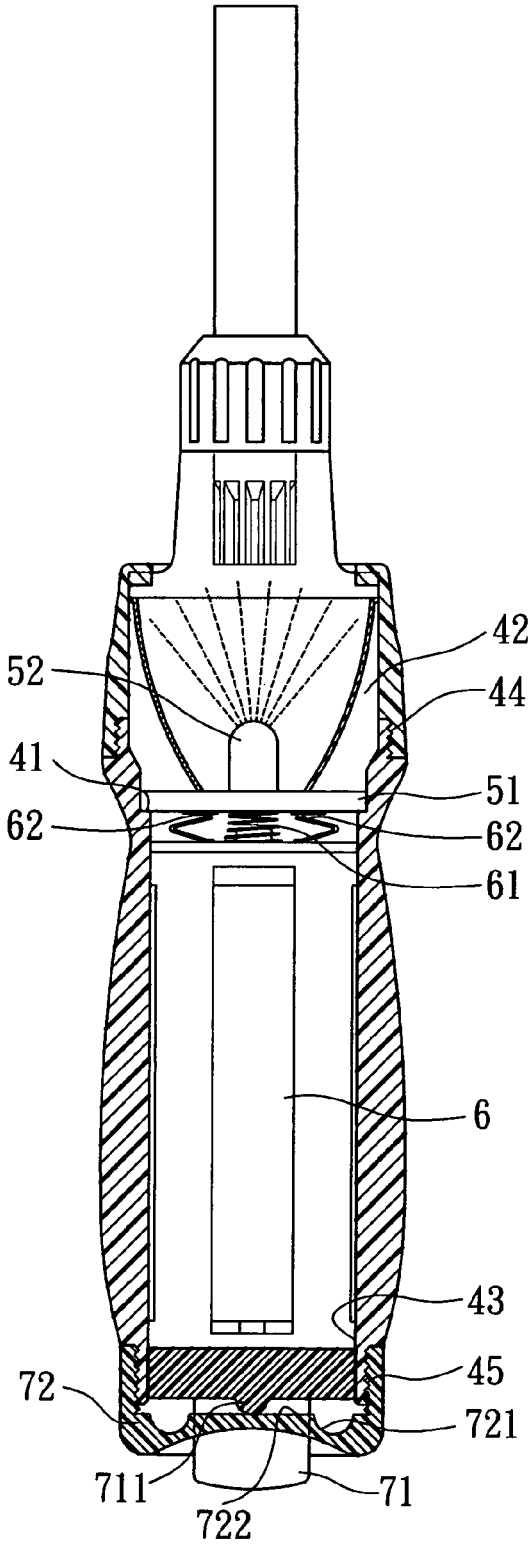
FIG. 3 is a cross sectional view to show the hand tool with the illuminating device of the present invention, wherein the switch member is rotated to turn on the illuminating device.

Referring to FIGS. 1 to 3, the hand tool with illuminating device of the present invention comprises a hollow handle 4 having a stepped shoulder 41 extending inward from an inner periphery thereof so as to define a first space 42 and a second space 43 in the handle 4. A first threaded connection section 44 extends from a front end of the handle 4 and a second threaded connection 45 extends from a second end of the handle 4.

An illuminating unit 5 is received in the first space 42 and includes a circuit board 51, a bulb 52 connected to a first side of the circuit board 51 and two first contact points 53 on a second side of the circuit board 51. A transparent seat 54 is connected to the first end of the handle 4 and includes a ratchet mechanism 551 received therein. A tubular member 55 is fixed to the transparent seat 54 and engaged with the ratchet mechanism 551. The tubular member 55 includes a polygonal recess with which driver bits can be removably inserted. The transparent seat 54 includes a plurality of recesses 541 defined in a top thereof. A locking member 56 is threadedly connected to the first threaded connection section 44 so as to position the transparent seat 54 and the illuminating unit 5. The locking member 56 includes a plurality of protrusions 561 which are engaged with the recesses 541. A reflector 542 is located between the transparent seat 54 and the circuit board 51. The reflector 542 includes a curved reflection surface and the bulb 52 is located at a focus of the reflection surface of the reflector 542.

A battery unit 6 is received in the second space 43 in the handle 4 and includes a spring 61 connected to a first end thereof. Two second contact points 62 extend from the first end of the battery unit 6.

A switch unit 7 is threadedly connected to the second threaded connection section 45 of the handle 4 and includes a switch member 71 and an end cap 72 which includes a through hole through which an elongate extension of the switch member 71 extends. The elongate extension extends from a first side of the switch member 71 and a second side of the switch member 71 is in contact with a second end of the battery unit 6. A control device 73 is located between the switch member 71 and the end cap 72. The control device 73 includes a plurality of bosses 711 extending from the first side of the switch member 71 and the bosses 711 are located around the elongate extension. A plurality of notches 721 are defined in an inner side of the end cap 72 and flat surfaces 722 are located between the notches 721. The bosses 711 are removably engaged with the notches 721 when rotating the elongate extension.

As shown in FIG. 3, when the elongate extension is rotated to let the bosses 711 remove from the notches 721 and contact the flat surfaces 722, the switch member 71 pushes the battery unit 6 to compress the spring 61 so that the first and second contact points 53, 62 are in contact with each other, the bulb 52 lights up and the beams are reflected by the reflector 542 and go through the transparent seat 54.

Figure 4:
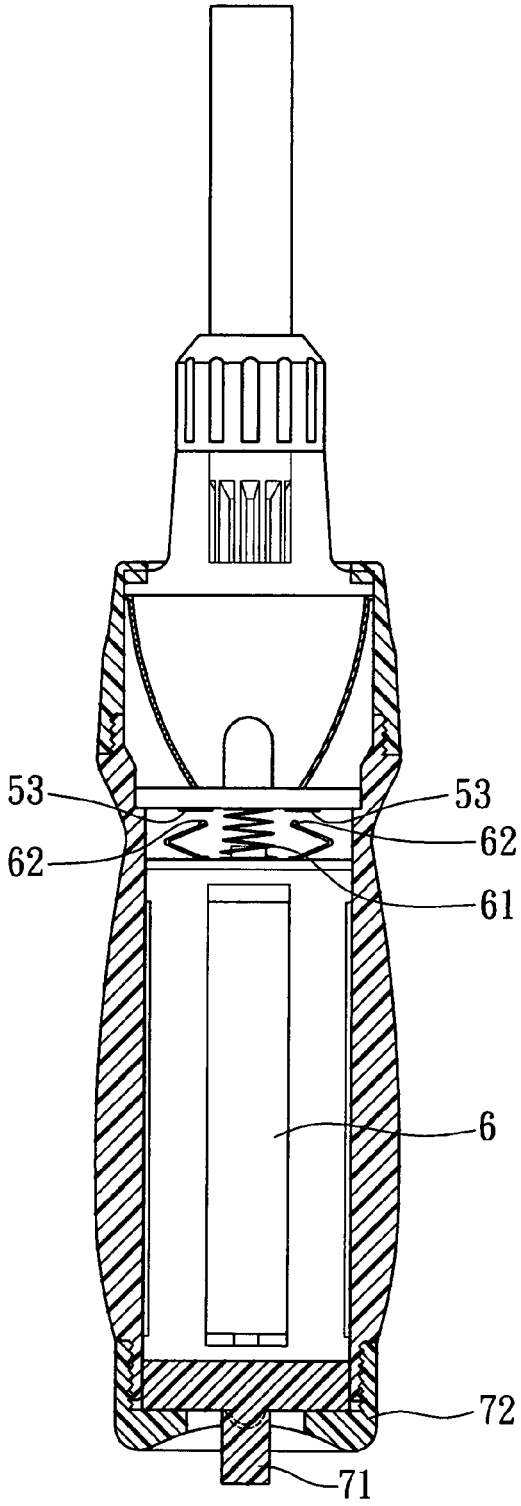
FIG. 4 is a cross sectional view to show the hand tool with the illuminating device of the present invention, wherein the switch member is rotated to turn off the illuminating device.

When rotating the elongate extension 71 as shown in FIG. 4 to move the bosses 711 to be received in the notches 721, the spring 61 pushes the battery unit 6 to separate the first and second contact points 53, 62, the bulb 52 turns off.

Figure 5:
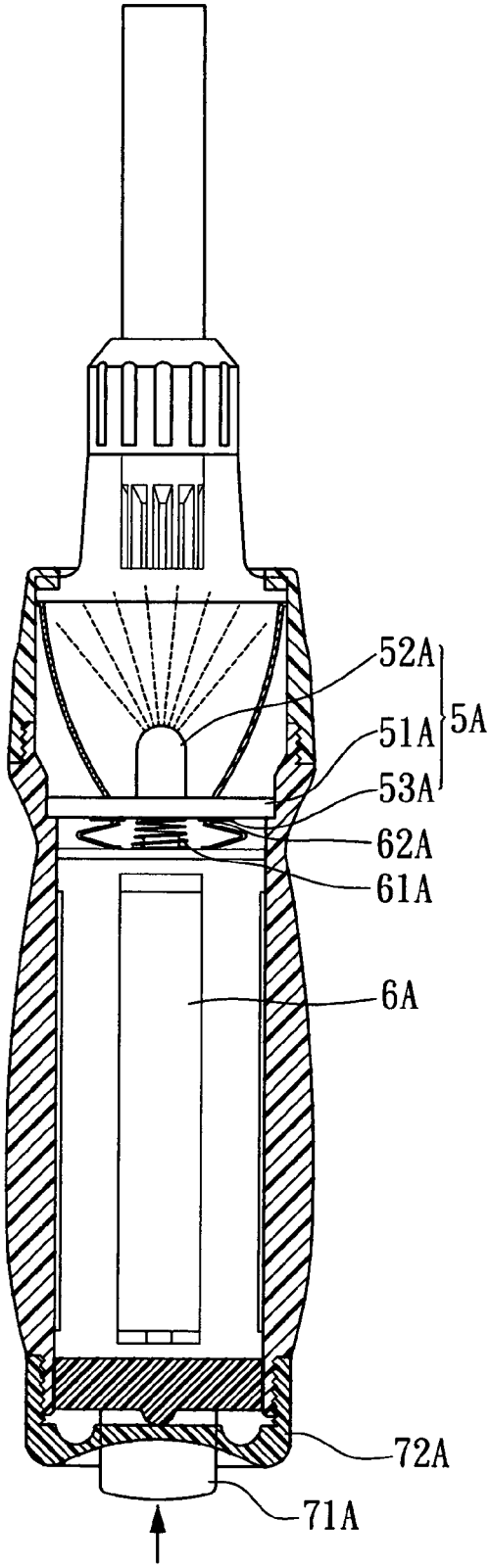
FIG. 5 is a cross sectional view to show the hand tool with the illuminating device of the present invention, wherein the switch member is a push button.
Figure 6:
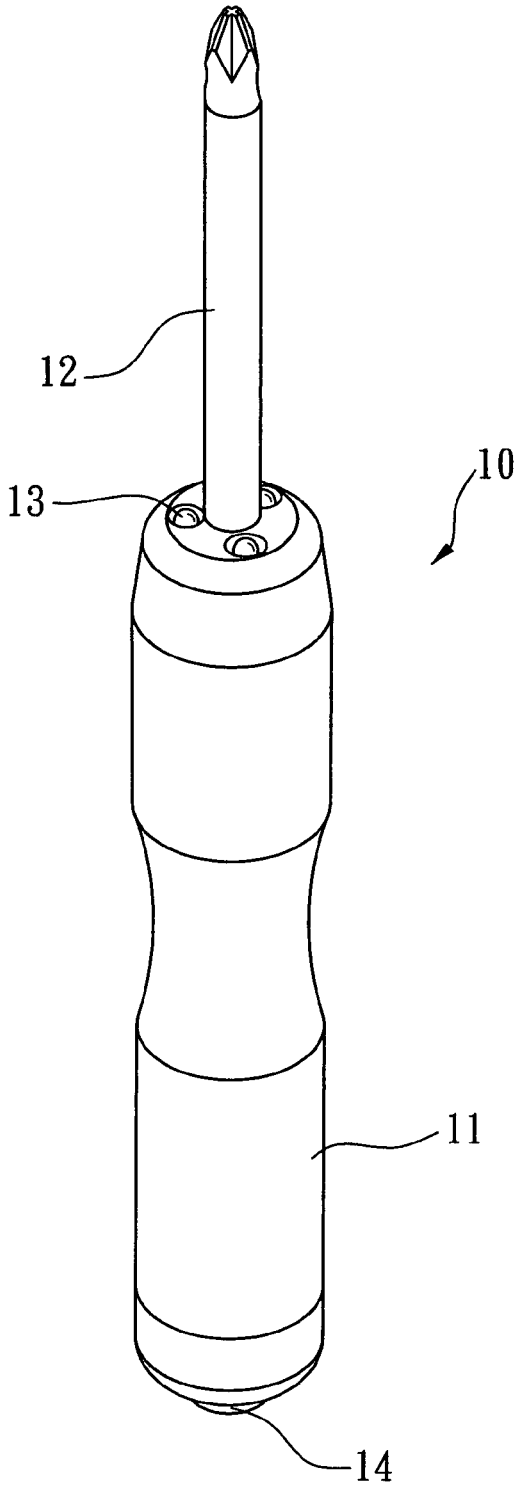
FIG. 6 PRIOR ART
FIG. 6 is a perspective view to show a conventional hand tool with illuminating device.
Figure 7:
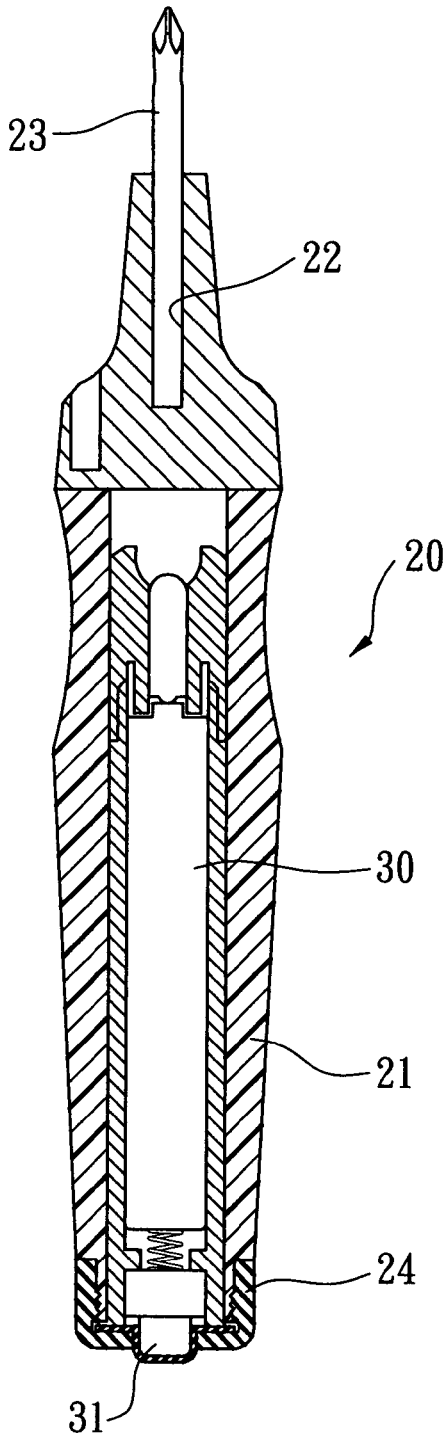
FIG. 7 PRIOR ART
FIG. 7 is a cross sectional view to show another conventional hand tool with illuminating device.

As shown in FIG. 5, the switch member 71A can be a push button which is pushed to turn the bulb 52A and turn off the bulb 52A by releasing the push button 71A.

While we have shown and described the embodiment in accordance with the present invention, it should be clear to those skilled in the art that further embodiments may be made without departing from the scope of the present invention.

What is claimed is:

1. A hand tool with illuminating device, comprising:

a hollow handle having a stepped shoulder extending inward from an inner periphery thereof so as to define a first space and a second space in the handle, a first connection section extending from a front end of the handle and a second connection extending from a second end of the handle;

an illuminating unit received in the first space and having a circuit board, a bulb connected to a first side of the circuit board and two first contact points on a second side of the circuit board;

a transparent seat connected to the first end of the handle and including a ratchet mechanism received therein;

a tubular member fixed to the transparent seat and engaged with the ratchet mechanism;

a locking member connected to the first connection section so as to position the transparent seat and the illuminating unit;

a battery unit received in the second space in the handle and having a spring connected to a first end thereof, two second contact points extending from the first end of the battery unit, and a switch unit connected to the second connection section of the handle and including a switch member and an end cap which includes a through hole through which the switch member extends, the switch member being in contact with a second end of the battery unit, a control device located between the switch member and the end cap.

2. The hand tool as claimed in claim 1, wherein the transparent seat includes a plurality of recesses defined in a top thereof and the locking member includes a plurality of protrusions which are engaged with the recesses.

3. The hand tool as claimed in claim 1, wherein the control device includes a plurality of bosses extending therefrom and a plurality of notches are defined in an inner side of the end cap, flat surfaces are located between the notches, the bosses are removably engaged with the notches.

4. The hand tool as claimed in claim 1, wherein the switch member includes an elongate extension which extends through the through hole of the end cap and the bosses are located around the elongate extension.

5. The hand tool as claimed in claim 1, wherein the switch member is a push button.

6. The hand tool as claimed in claim 1, wherein a reflector is located between the transparent seat and the circuit board, the bulb is located at a focus of the reflector.

* * * * *